US006829577B1

(12) United States Patent
Gleason

(10) Patent No.: US 6,829,577 B1
(45) Date of Patent: Dec. 7, 2004

(54) GENERATING NON-STATIONARY ADDITIVE NOISE FOR ADDITION TO SYNTHESIZED SPEECH

(75) Inventor: Philip Gleason, Boca Raton, FL (US)

(73) Assignee: International Business Machines Corporation, Armonk, NY (US)

( * ) Notice: Subject to any disclaimer, the term of this patent is extended or adjusted under 35 U.S.C. 154(b) by 872 days.

(21) Appl. No.: 09/705,849

(22) Filed: Nov. 3, 2000

(51) Int. Cl.[7] ..... G10L 13/02; G10L 19/04; G10L 21/02

(52) U.S. Cl. ..... 704/207; 704/209; 704/219; 704/226; 704/262

(58) Field of Search ..... 704/205, 207, 704/209, 226, 227, 258, 260, 261, 262, 264, 268, 219

(56) References Cited

U.S. PATENT DOCUMENTS 5,495,556 A * 2/1996 Honda ..... 704/265
5,872,727 A * 2/1999 Kuo ..... 708/313
6,163,608 A * 12/2000 Romesburg et al. ..... 379/406.1
6,219,427 B1 * 4/2001 Kates et al. ..... 381/318
6,269,331 B1 * 7/2001 Alanara et al. ..... 704/205
6,336,092 B1 * 1/2002 Gibson et al. ..... 704/268
6,463,406 B1 * 10/2002 McCree ..... 704/207
6,606,593 B1 * 8/2003 Jarvinen et al. ..... 704/223
6,675,144 B1 * 1/2004 Tucker et al. ..... 704/264
6,704,711 B2 * 3/2004 Gustafsson et al. ..... 704/258
6,708,024 B1 * 3/2004 Yip ..... 455/226.4
6,708,154 B2 * 3/2004 Acero ..... 704/260
6,738,457 B1 * 5/2004 Pickering et al. ..... 379/88.16
6,751,587 B2 * 6/2004 Thyssen et al. ..... 704/228

OTHER PUBLICATIONS

Dennis H. Klatt, *Software for a Cascade/Parallel Formant Synthesizer*, 53 J. Acoust. Soc. Am. at 8–16 (1980).
A.M. Turing, *Computing Machinery and Intelligence*, 59 Mind at 433–460 (1950).

* cited by examiner

*Primary Examiner*—Richemond Dorvil
*Assistant Examiner*—Martin Lerner
(74) *Attorney, Agent, or Firm*—Akerman Senterfitt

(57) ABSTRACT

A method for producing vowel sounds in a waveform generator using non-stationary additive noise (NSAN) can include computing a frequency spectrum for a selected group of pitch pulses in a recorded sample of a spoken vowel; identifying a set of formant values in the computed frequency spectrum and creating an all-pole filter for the set of identified formant values; populating a zero-padded matrix with the selected group of pitch pulses and applying the all-pole filter to the matrix, the application of the filter producing a set of NSAN vectors; synthesizing a vowel sound in the waveform generator, the synthesis producing a further group of pitch pulses; and, adding the NSAN vectors to the further group of pitch pulses.

28 Claims, 2 Drawing Sheets

GENERATING NON-STATIONARY ADDITIVE NOISE FOR ADDITION TO SYNTHESIZED SPEECH

CROSS REFERENCE TO RELATED APPLICATIONS (Not Applicable)

STATEMENT REGARDING FEDERALLY SPONSORED RESEARCH OR DEVELOPMENT (Not Applicable)

BACKGROUND OF THE INVENTION

1. Technical Field

This invention relates to the field of speech synthesis and more particularly to a method and apparatus for synthesizing vowels in a speech synthesizer.

2. Description of the Related Art

Phonetics is the scientific study of all aspects of speech. Phonetics can be divided into acoustic phonetics and articulatory phonetics. Acoustic phonetics is concerned with the structures and patterns of acoustic signals. Articulatory phonetics is concerned with the ways sounds are produced, for example by describing speech sounds in terms of the positions of the vocal organs when producing any given sound. By comparison, speech synthesis is the process of producing audibly recognizable speech output in a computing system. Speech synthesizers, for example Text-to-Speech (TTS) Engines, can process computer-readable text into synthesized speech by applying the principles of acoustic and articulatory phonetics to the structure and composition of the computer-readable text in order to computationally produce speech.

The conventional division of speech sounds both in the study of phonetics and in the synthesis of speech can be classified into vowels and consonants. Consonants can be characterized by the human formation of the consonant sound. Specifically, to form a consonant, the airstream through the human vocal tract typically is obstructed in some manner. As such, consonants are classified according to this obstruction, for instance, the place of articulation, the manner of articulation and the presence or absence of voicing. In contrast, vowels, unlike consonants, exhibit a great deal of dialectic variation. This variation can depend on factors such as geographical region, age and gender. Vowels can be differentiated from consonants by the relatively wide opening in the human mouth as air passes from the lungs out of the human body. Accordingly, there is very little obstruction of the airstream in comparison to consonants. Typically, vowels can be described in terms of tongue position and lip shaping.

Notably, vowel sounds produced by speech synthesizers can have a buzzing quality which can prove undesirable to the user of a TTS Engine. It has been shown, however, that the application of non-stationary additive noise (NSAN) to synthesized vowels can mask this buzzing quality. Furthermore, experimentally it has been shown that the application of NSAN to synthesized vowels can improve the perceived naturalness of the vowel sounds. Accordingly, it can be preferable to apply NSAN to synthesized vowel sounds in a TTS engine.

SUMMARY OF THE INVENTION

A method for generating non-stationary additive noise (NSAN) for addition to synthesized speech can include selecting a group of pitch pulses in a recorded sample of a spoken vowel; computing a frequency spectrum for the selected group of pitch pulses; identifying formant values in the computed frequency spectrum; creating an all-zero filter based upon the identified formant values; populating a zero-padded matrix with the selected group of pitch pulses; and, applying the all-zero filter to the matrix. The application of the all-zero filter to the matrix can produce NSAN vectors, each NSAN vector corresponding to a pitch pulse in the group of pitch pulses.

In one aspect of the invention, the step of selecting a group of pitch pulses can include selecting twenty pitch pulses in the recorded sample of speech. Additionally, the twenty pitch pulses can be positioned in the center of the recorded sample. In another aspect of the invention, the identifying step can include identifying the first three formant values in the computed frequency spectrum. In yet another aspect of the invention, the step of computing a frequency spectrum can include applying a linear predictive coding (LPC) process to the selected group of pitch pulses. Notably, the LPC process can extract predictive coefficients from the selected group of pitch pulses. As a result, the step of creating an all-zero filter can further include configuring the all-zero filter with the extracted predictive coefficients.

The method of the invention also can include low-pass filtering the recorded sample and selecting a group of filtered pitch pulses in the filtered sample, wherein each filtered pitch pulse in the selected group of the filtered sample corresponds to a pitch pulse in the selected group of the recorded sample. Subsequently, each NSAN vector can be added to a corresponding filtered pitch pulse in the selected group of the filtered sample. Moreover, each added NSAN vector can correspond to a filtred pitch pulse which corresponds to a pulse in the recorded sample having a correspondence with the added NSAN vector.

Notably, the step of low-pass filtering can include determining a fundamental frequency for the recorded sample; and, passing the recorded sample through a low-pass cut-off filter configured with cut-off frequencies corresponding to the first formant and the fundamental frequency. Furthermore, the step of passing can include passing the recorded sample through the low-pass cut-off filter both forwards and backwards.

By comparison, a method for producing vowel sounds in a waveform generator using NSAN can include computing a frequency spectrum for a selected group of pitch pulses in a recorded sample of a spoken vowel; identifying a set of formant values in the computed frequency spectrum and creating an all-zero filter for the set of identified formant values; populating a zero-padded matrix with the selected group of pitch pulses and applying the all-zero filter to the matrix, the application of the filter producing a set of NSAN vectors; synthesizing a vowel sound in the waveform generator, the synthesis producing a further group of pitch pulses; and, adding the NSAN vectors to the further group of pitch pulses.

The step of computing a frequency spectrum can include applying a linear predictive coding (LPC) process to the selected group of pitch pulses. Notably, the LPC process can extract predictive coefficients from the selected group of pitch pulses. As a result, the step of creating an all-zero filter can further include configuring the all-zero filter with the extracted predictive coefficients.

The identifying step can include identifying the first three formant values in the computed frequency spectrum. Finally, the adding step can include sampling the synthesized vowel sound and selecting a group of pitch pulses in the sampled vowel sound; and, for each pitch pulse in the sample, re-sampling a corresponding NSAN vector to the length of the pitch pulse, multiplying the re-sampled NSAN vector by a scaling factor and adding the NSAN vector to the pitch pulse.

BRIEF DESCRIPTION OF THE DRAWINGS

There are presently shown in the drawings embodiments which are presently preferred, it being understood, however, that the invention is not limited to the precise arrangements and instrumentalities shown.

DETAILED DESCRIPTION OF THE INVENTION

The present invention is a method and apparatus for generating non-stationary additive noise (NSAN) for addition to synthesized speech produced in a speech synthesizer. Notably, the speech synthesizer can be included as part of a TTS engine for converting computer-readable text to synthesized speech. The method of the invention can produce NSAN from recorded speech and, subsequently, can apply the NSAN to vowel sounds produced in the speech synthesizer. In consequence, the application of the NSAN to the vowel sounds can mask the buzzing quality typically associated with the conventional speech synthesis of vowel sounds. Thus, synthesized speech produced using the inventive method can have a perceived naturalness not typically associated with synthesized speech containing conventionally produced vowel sounds.

Figure 1:
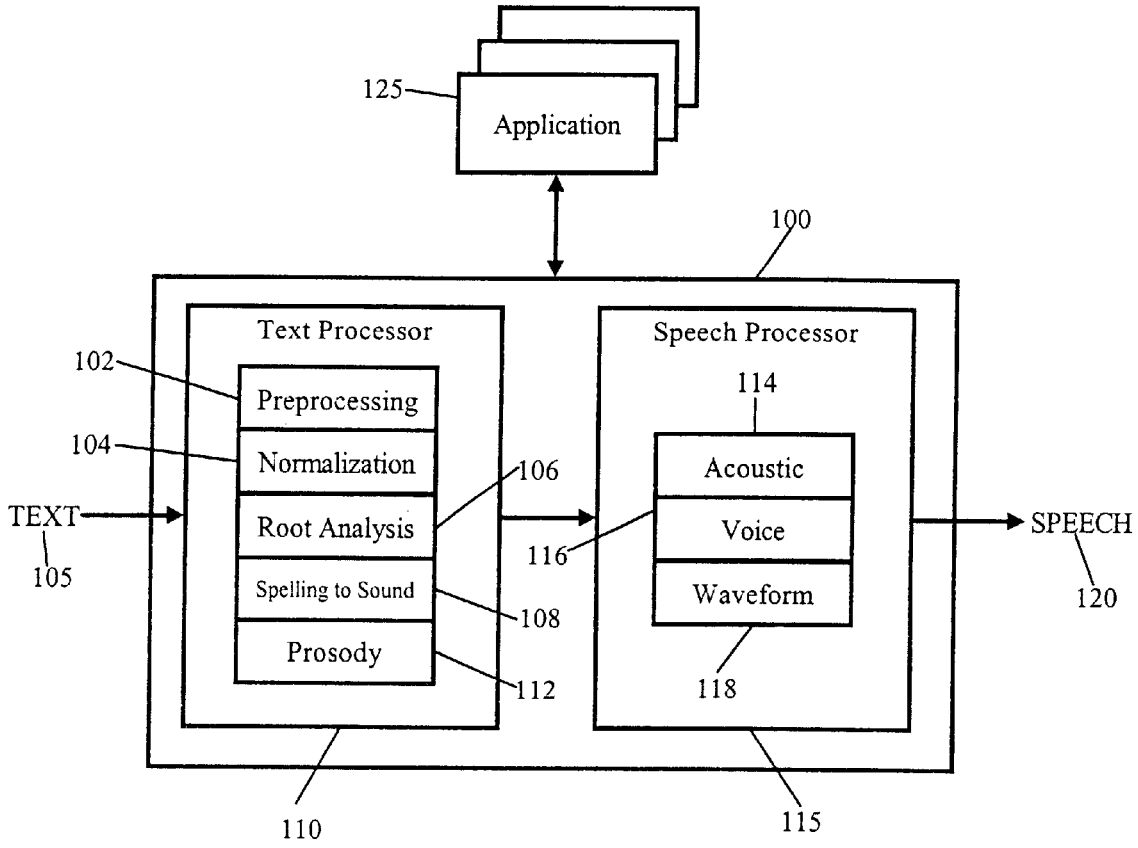
FIG. 1 is a schematic representation of a Text-to-Speech (TTS) Engine suitable for producing synthesized speech in accordance with the inventive arrangements.

FIG. 1 illustrates a TTS engine 100 suitable for use in the present invention. As shown in FIG. 1, a TTS engine 100 suitable for use in the present invention can include a text processor 110 and a speech processor 115. The text-processor 110 can parse input text 105 into a set of linguistic units, for instance phonemes. The speech processor 115 can receive the phonemes and can generate the synthesized speech waveform 120. Notably, the synthesized speech waveform 120 can be in the form of a digital waveform suitable for use by audio circuitry, for example a sound card. Still, the invention is not limited in this regard and the synthesized speech waveform 120 also can be a digital representation of synthesized speech suitable for further processing by TTS-aware application 125.

The text processor 110 can include a pre-processing module 102, a normalization module 104, a root analysis module 106, a spelling-to-sound module 108, and a prosody module 112. In the pre-processing module 102, the text input 105 can be scanned for pre-defined strings, annotations and phonetic spellings. In particular, during pre-processing user dictionaries can be consulted in consequence of which suitable replacements can be substituted for the pre-defined strings, annotations and phonetic spellings in the text input 105. Subsequently, in the normalization module 104, each character string not identified as an annotation or phonetic spelling can be converted into a word or series of words, spelled with letters of a selected alphabet, for example the English alphabet. For instance, during normalization, the text string "32" can be converted to "thirty-two" and the text string "=" can be converted to "equals".

The root analysis module 106 can analyze each word in the pre-processed and normalized text input and can characterize each word in terms of roots and affixes. In particular, a roots dictionary can be consulted to retrieve any user-specified pronunciations of roots. In the spelling-to-sound module 108, the spelled words can be converted into a phonetic representation of the speech (phonemes) using pre-defined spelling-to-sound rules. Finally, the prosody module 112 can include prosody rules which can determine appropriate timing and melody for the speech converted text. Upon completion of prosody processing, an abstract linguistic representation of the speech can be provided to the speech processor 115 in which the abstract linguistic representation can be converted into actual acoustic values.

The speech processor 115 can include three components: an acoustic processor 114, a voice processor 116, and a waveform generator 118. The acoustic processor 114 can generate acoustic values for the abstract linguistic representation. The acoustic values can be used to produce the phonemes and prosodic patterns specified by the text processor 110. Subsequently, the voice processor 116 can supplement the acoustic values with voice characteristics. Finally, the waveform generator 118 can produce the synthesized speech waveform 120 which can be transmitted to a TTS-aware application 125 or directly to audio circuitry, for example a sound card. Notably, in one aspect of the present invention, the waveform generator can be a Klatt type synthesizer as described in D. H. Klatt, *Software for a Cascade/Parallel Formant Synthesizer,* 53 J. Acoust. Soc. Am. at 8–16 (1980), incorporated herein by reference.

Significantly, vowel sounds produced by the TTS Engine 100, in the absence of the present invention, can have a buzzy quality as perceived by a listener. Hence, to mask the buzzy quality of speech synthesized vowels and to produce a perceived naturalness of speech synthesized vowel sounds, NSAN can be generated and applied to speech synthesized vowels produced by the waveform generator 118 in the speech processor 115 of the TTS Engine 100. Specifically, FIG. 2 is a diagram of a process 200 for generating NSAN for addition to synthesized vowels in the TTS Engine 100.

Figure 2:
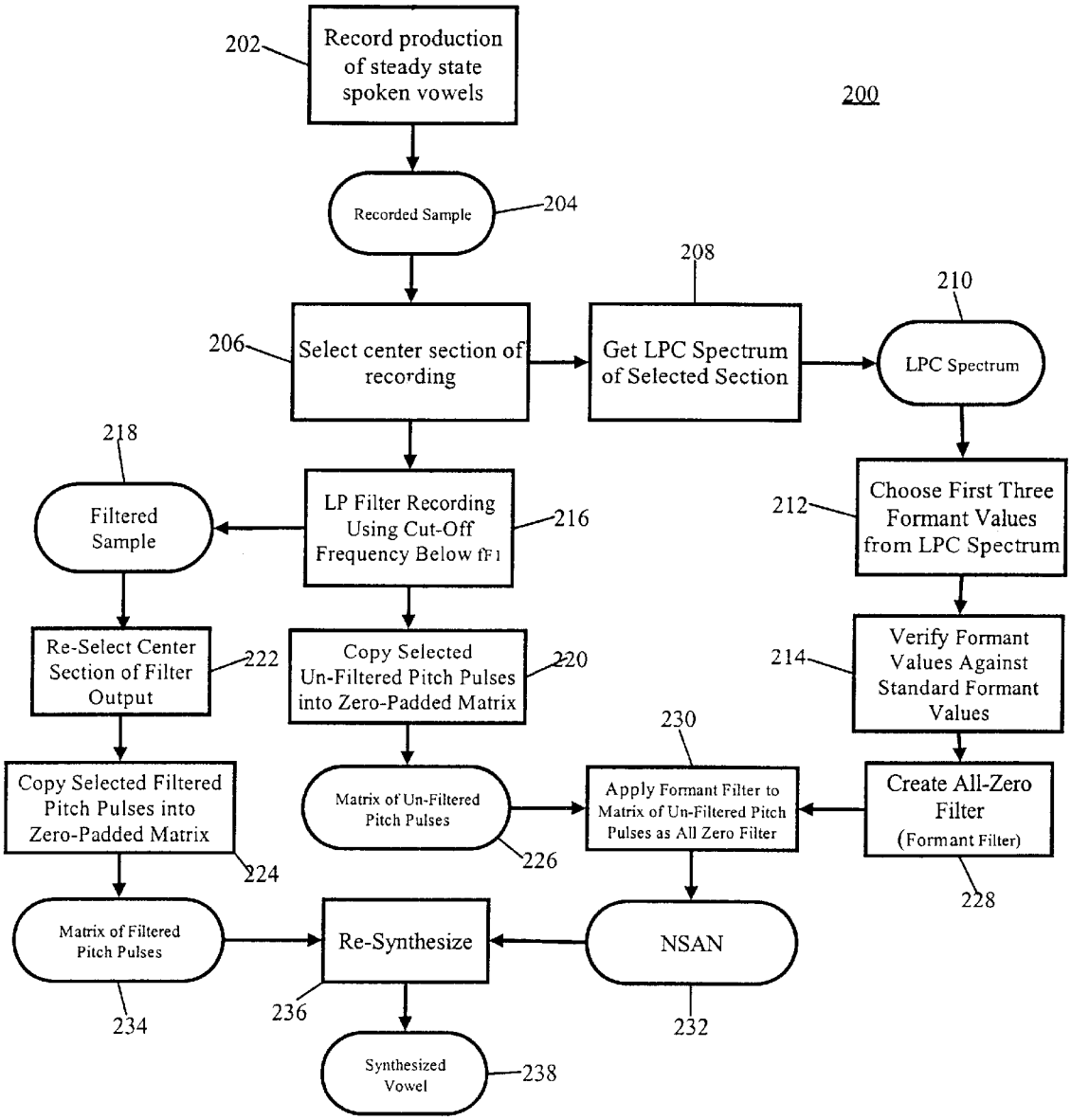
FIG. 2 is a diagram of a process of generating non-stationary additive noise (NSAN) for addition to synthesized speech produced in the TTS Engine of FIG. 1.

As shown in FIG. 2, the process 200 can include a recording step 202 in which a spoken vowel can be recorded. The spoken vowel can be recorded while in a steady state producing a recorded sample 204. Specifically, the spoken vowel can be recorded when the fundamental frequency of the spoken vowel is not changing (the fundamental frequency—the pitch of a sound—can be estimated by observing the rate of occurrence of the peaks in a waveform). Additionally, the spoken vowel can be recorded when the vowel value also is not changing. In consequence, the recorded sample 204 can contain an optimal specification of corresponding formant values and spoken vowel bandwidth. In particular, if when recording the spoken vowel, the spoken vowel drifts in fundamental frequency or vowel value, the formant values derived therefrom can be inaccurate.

In step 206, a center section of the recorded sample 204 can be selected. More particular, a section of the recorded sample 204 can be selected which can include a set of pitch pulses suitable for identifying the vowel. In one aspect of the invention, twenty (20) pitch pulses can be selected in a steady state portion of the recorded sample 204. In some cases, the steady state portion of the recorded sample can appear near the center of the recorded sample. Still, the invention is neither limited in regard to the particular number of pitch pulses selected nor the location of the pitch pulses. Rather, only a set of pitch pulses selected from a steady state portion of the recorded sample 204 is necessary in the present invention.

To determine the phonetic properties of the selected portion of the recorded sample 204, the selected portion can be decomposed from a complex waveform into individual waveforms comprising the complex waveform. This spectrographic analysis can reveal that the vowel has certain frequency bands with markedly high amplitudes or energy. These bands of high energy frequencies that occur in vowels are frequently referred to as formants. As is well known in the art, formants correspond to certain resonances of the vocal tract.

Hence, in step 208, an linear predictive coding (LPC) vocoder can compute an LPC spectrum for the selected portion of the recorded sample 204. Similar to conventional formant vocoders, using an LPC vocoder, predictor coefficients representing pitch, loudness and vocal tract shape can be extracted from the selected portion of the recorded sample.

By processing the selected portion of the recorded sample 204 in the LPC vocoder, an LPC frequency spectrum 210 can be produced. As is well known in the art, most of the information in a speech signal is contained in the first three formants. That is, a particular vowel can be identified by the first three formants. Accordingly, in step 212, the first three formant values (frequencies) can be selected in the LPC frequency spectrum 210. Notably, false formants are possible which can be caused by dipliphonia. As such, in step 214, the selected formant values can be verified against standard formant values for the recorded vowel.

Turning our attention to step 216, the recorded sample 204 can be low-pass filtered using a cut-off frequency below the frequency of the selected first formant and above the fundamental frequency. In consequence, a filtered sample 218 can be produced. Significantly, the low-pass filter can filter the recorded sample 204 both forwards and backwards in order to eliminate a shift in the timing of the filtered sample 218. Additionally, by filtering the recorded sample 204 both forwards and backwards, the time alignment can be preserved between the recorded sample 204 and the filtered sample 218.

In step 222, a section of the filtered sample can be selected. Specifically, a center section of the filtered sample 218 which corresponds to the center section of the selected portion of the recorded sample 204 can be selected. Thus, where twenty pitch pulses have been selected in step 206, in step 222, a corresponding twenty pitch pulses can be selected in the filtered sample 218. In step 224, each individual pitch pulse in the selected portion of the filtered sample 218 can be copied into a cell of a zero-padded matrix of filtered pitch pulses 234. In particular, each pitch pulse can be identified by a leading and trailing zero crossing, which, if the cut-off frequency of the low-pass filter has been set to a low enough value, should be unambiguous. Notably, the pitch pulses need not be truncated to a uniform length.

Correspondingly, in step 220, each individual pitch pulse in the selected portion of the recorded sample 204 can be copied into a cell of a second zero-padded matrix of unfiltered pitch pulses 226. Specifically, each unfiltered pitch pulse can correspond to the same interval as the corresponding filtered pitch pulse. Hence, there can be a one-to-one correspondence of filtered and unfiltered pitch pulses. Each pitch pulse pair can share the same number of sample points, albeit the number of sample points can vary from pair to pair.

Turning now to step 228, an all-zero filter can derived from an all-pole filter created using the formant values (frequencies) selected in step 212. Notably, all-pole digital filters focus on spectral maxima of a signal. Accordingly, all-pole digital filters can be particularly sensitive to formants in a vowel sound. The predictor coefficients of step 208 can be used to control the all-zero digital filter in such a way as to replicate the formants and other frequency variations in the recorded sample 204. Methods for creating an all-pole filter are well-known in the art and are described in detail in Klatt. Moreover, methods for deriving an all-zero filter therefrom also are well-known in the art and are described in Klatt.

In step 230, the all-zero filter created in step 228 can be applied to the matrix of unfiltered pitch pulses 226. By applying me all-zero filter to the matrix of unfiltered pitch pulses 226, each unfiltered pitch pulse in the matrix of unfiltered pitch pulses 226 can be individually filtered. This is equivalent to the inverse filtering of each of the matrix of unfiltered pitch pulses 226. Notably, the inverse filtering process of step 230 is analogous To deriving an LPC model of each individual unfiltered pitch pulse. However, in the analogous case, the residue of the LPC analysis is while noise, whereas the residue of the inverse filtering process of step 230 is a set of NSAN vectors 232. Significantly, the set of NSAN vectors 232 produced by the inverse filtering process of step 230 is not white noise because the order of the inverse filter is deliberately kept low. Thus, unlike white noise traditionally found in conventional waveform generators, the set of NSAN vectors 232 produced by the method of the invention can retain some of the temporal structure of the original recorded sample 204.

Finally, in step 238, during speech synthesis, the vowel sound can be resynthesized by adding the low-pass filtered pitch pulses to the corresponding NSAN vectors 232. In one aspect of the invention, the ratio between the amplitude of each filtered pitch pulse and the corresponding NSAN vector 232 can be 3:1. The resulting composite pulses can be concatenated in random order. Notably, any number of composite pulses can be concatenated. Finally, the concatenated pulses can passed through the all-pole filter of step 228 in order to produce the synthesized vowel 238. Thus, by substituting the set of NSAN vectors 232 for white noise (breathiness) produced by conventional waveform generators, the buzzing quality of the vowel sound can be masked.

I claim:

1. A method for generating non-stationary additive noise (NSAN) comprising:

selecting a group of pitch pulses in a recorded sample of a spoken vowel;

computing a frequency spectrum for said selected group of pitch pulses;

identifying formant values in said computed frequency spectrum;

creating an all-zero filter based upon said identified formant values;

populating a zero-padded matrix with said selected group of pitch pulses; and, applying said all-zero filter to said matrix, wherein said application of said all-zero filter to said matrix produces NSAN vectors, each said NSAN vector corresponding to a pitch pulse in said group of pitch pulses.

2. The method of claim 1, wherein said step of selecting a group of pitch pulses comprises:

selecting twenty pitch pulses in said recorded sample of speech.

3. The method of claim 2, wherein said twenty pitch pulses are positioned in the center of said recorded sample.

4. The method of claim 1, wherein said step of computing a frequency spectrum comprises:

applying a linear predictive coding (LPC) process to said selected group of pitch pulses;

said LPC process extracting predictive coefficients from said selected group of pitch pulses.

5. The method of claim 1, wherein said identifying step comprises identifying the first three formant values in said computed frequency spectrum.

6. The method of claim 1, wherein said step of creating an all-pole filter further comprises:

configuring said all-zero filter with said extracted predictive coefficients.

7. The method of claim 1, further comprising:

low-pass filtering the recorded sample, selecting a group of filtered pitch pulses in said filtered sample, each filtered pitch pulse in said selected group of said filtered sample corresponding to a pitch pulse in said selected group of said recorded sample, and adding each NSAN vector to a corresponding filtered pitch pulse in said selected group of said filtered sample, each added NSAN vector corresponding to a filtered pitch pulse which corresponds to a pitch pulses in said recorded sample having a correspondence with said added NSAN vector.

8. The method of claim 7, wherein said step of low-pass filtering comprises:

determining a fundamental frequency for said recorded sample; and, passing said recorded sample through a low-pass cut-off filter configured with cut-off frequencies corresponding to said first formant and said fundamental frequency.

9. The method of claim 8, wherein said step of passing comprises:

passing said recorded sample through said low-pass cut-off filter both forwards and backwards.

10. A method for producing vowel sounds in a waveform generator using non-stationary additive noise (NSAN) comprising:

computing a frequency spectrum for a selected group of pitch pulses in a recorded sample of a spoken vowel;

identifying a set of formant values in said computed frequency spectrum and creating an all-zero filter for said set of identified formant values;

populating a zero-padded matrix with said selected group of pitch pulses and applying said all-zero filter to said matrix, said application of said filter producing a set of NSAN vectors;

synthesizing a vowel sound in the waveform generator, said synthesis producing a further group of pitch pulses; and, adding said NSAN vectors to said further group of pitch pulses.

11. The method of claim 10, wherein said step of computing a frequency spectrum comprises:

applying a linear predictive coding (LPC) process to said selected group of pitch pulses;

said LPC process extracting predictive coefficients from said selected group of pitch pulses.

12. The method of claim 10, wherein said identifying step comprises identifying the first three formant values in said computed frequency spectrum.

13. The method of claim 11, wherein said step of creating an all-zero filter further comprises:

configuring said all-zero filter with said extracted predictive coefficients.

14. The method of claim 10, where said adding step comprises:

sampling said synthesized vowel sound and selecting a group of pitch pulses in said sampled vowel sound; and, for each pitch pulse in said sample, re-sampling a corresponding NSAN vector to the length of said pitch pulse, multiplying said re-sampled NSAN vector by a scaling factor and adding said NSAN vector to said pitch pulse.

15. A machine readable storage, having stored thereon a computer program having a plurality of code sections for generating non-stationary additive noise (NSAN) for addition to synthesized speech, said code sections executable by a machine for causing the machine to perform the steps of:

selecting a group of pitch pulses in a recorded sample of a spoken vowel;

computing a frequency spectrum for said selected group of pitch pulses;

identifying formant values in said computed frequency spectrum;

creating an all-zero filter based upon said identified formant values;

populating a zero-padded matrix with said selected group of pitch pulses; and, applying said all-zero filter to said matrix as an all-zero filter, wherein said application of said all-zero filter to said matrix produces NSAN vectors, each said NSAN vector corresponding to a pitch pulse in said group of pitch pulses.

16. The machine readable storage of claim 15, wherein said step of selecting a group of pitch pulses comprises:

selecting twenty pitch pulses in said recorded sample of speech.

17. The machine readable storage of claim 16, wherein said twenty pitch pulses are positioned in the center of said recorded sample.

18. The machine readable storage of claim 15, wherein said step of computing a frequency spectrum comprises:

applying a linear predictive coding (LPC) process to said selected group of pitch pulses;

said LPC process extracting predictive coefficients from said selected group of pitch pulses.

19. The machine readable storage of claim 15, wherein said identifying step comprises identifying the first three formant values in said computed frequency spectrum.

20. The machine readable storage of claim 15, wherein said step of creating an all-pole filter further comprises:

configuring said all-zero filter with said extracted predictive coefficients.

21. The machine readable storage of claim 15, further comprising:

low-pass filtering the recorded sample, selecting a group of filtered pitch pulses in said filtered sample, each filtered pitch pulse in said selected group of said filtered sample corresponding to a pitch pulse in said selected group of said recorded sample, and adding each NSAN vector to a corresponding filtered pitch pulse in said selected group of said filtered sample, each added NSAN vector corresponding to a filtered pitch pulse which corresponds to a pitch pulses in said recorded sample having a correspondence with said added NSAN vector.

22. The machine readable storage of claim 21, wherein said step of low-pass filtering comprises:

determining a fundamental frequency for said recorded sample; and, passing said recorded sample through a low-pass cut-off filter configured with cut-off frequencies corresponding to said first formant and said fundamental frequency.

23. The machine readable storage of claim 22, wherein said step of passing comprises:

passing said recorded sample through said low-pass cut-off filter both forwards and backwards.

24. A machine readable storage, having stored thereon a computer program having a plurality of code sections for producing vowel sounds in a waveform generator using non-stationary additive noise (NSAN), said code sections executable by a machine for causing the machine to perform the steps of:

computing a frequency spectrum for a selected group of pitch pulses in a recorded sample of a spoken vowel;

identifying a set of formant values in said computed frequency spectrum and creating an all-pole filter for said set of identified formant values;

populating a zero-padded matrix with said selected group of pitch pulses and applying said all-pole filter to said matrix, said application of said filter producing a set of NSAN vectors;

synthesizing a vowel sound in the waveform generator, said synthesis producing a further group of pitch pulses; and, adding said NSAN vectors to said further group of pitch pulses.

25. The machine readable storage of claim 24, wherein said step of computing a frequency spectrum comprises:

applying a linear predictive coding (LPC) process to said selected group of pitch pulses;

said LPC process extracting predictive coefficients from said selected group of pitch pulses.

26. The machine readable storage of claim 24, wherein said identifying step comprises identifying the first three formant values in said computed frequency spectrum.

27. The machine readable storage of claim 25, wherein said step of creating an all-zero filter further comprises:

configuring said all-zero filter with said extracted predictive coefficients.

28. The machine readable storage of claim 24, where said adding step comprises:

sampling said synthesized vowel sound and selecting a group of pitch pulses in said sampled vowel sound; and, for each pitch pulse in said sample, re-sampling a corresponding NSAN vector to the length of said pitch pulse, multiplying said re-sampled NSAN vector by a scaling factor and adding said NSAN vector to said pitch pulse.

* * * * *